US005798745A

United States Patent [19]

Steffensmeier

[11] Patent Number: 5,798,745

[45] Date of Patent: Aug. 25, 1998

[54] LCD PANEL HAVING TAILORED PUSHDOWN VOLTAGES

[75] Inventor: Martin J. Steffensmeier, Cedar Rapids, Iowa

[73] Assignee: Rockwell International, Costa Mesa, Calif.

[21] Appl. No.: 723,404

[22] Filed: Sep. 30, 1996

[51] Int. Cl.[6] ..... G09G 3/18

[52] U.S. Cl. ..... 345/92; 345/88; 345/94; 345/208; 349/42

[58] Field of Search ..... 345/87, 88, 92, 345/94, 208, 210; 349/39, 41, 42, 43, 46

[56] References Cited

U.S. PATENT DOCUMENTS

| | | | |
|---|---|---|---|
| 5,089,810 | 2/1992 | Shapiro et al. | 345/88 |
| 5,414,283 | 5/1995 | den Boer et al. | 349/43 |
| 5,459,596 | 10/1995 | Veda et al. | 349/39 |
| 5,510,805 | 4/1996 | Lee | 345/99 |

*Primary Examiner*—Lun-Yi Lao

*Attorney, Agent, or Firm*—Kyle Eppele; L. Keith Stephens; James P. O'Shaughnessy

[57] ABSTRACT

A display element in a liquid-crystal display having a tailored pushdown voltage is described wherein the pushdown voltage of the display element may be tailored to a predetermined compensation level by varying the size of the thin-film transistor switch of the display element, by varying the size of the storage capacitor of the display element, or by varying both the size of the thin-film transistor switch and the size of the storage capacitor. The pushdown voltage of the display element may be further tailored in conjunction with the cell gap of the display panel. Precise manipulation of the output of the liquid-crystal display may be achieved through manipulation of the size of the thin-film transistor and the storage capacitor wherein various parameters may be controlled including luminance, color balance and aperture ratio for individual colors.

5 Claims, 1 Drawing Sheet

LCD PANEL HAVING TAILORED PUSHDOWN VOLTAGES

BACKGROUND OF THE INVENTION

The present invention generally relates to the field of liquid-crystal displays, and more particularly to a liquid-crystal display having tailored pushdown voltage for each sub-pixel display element.

There are many applications, in which it is desirable to be able to provide a liquid-crystal display in which the parameters of the display are precisely controlled. For example, in an avionics environment, it would be advantageous to provide a color liquid-crystal cockpit display in which each color radiates at the same luminance as the other colors to maximize readability of the display and to minimize fatigue in reading the display for extended periods.

In addition, it is often desirable to be able to provide a display in which the display driver requirements are simple and uniform. For example, in multicolor (RGB) active matrix displays, each sub-pixel display element must be driven with a precisely controlled voltage in order to produce accurate colors wherein the driving voltage is different for each color. Therefore, the driving voltage must be tailored to each sub-pixel color. Typically, the applied driving voltage exceeds the required driving voltage level and is therefore decreased, or pushed down, to the correct value. Thus, it would be desirable to provide a liquid-crystal display in which the pushdown voltage is tailored for each display element to achieve the correct driving voltage.

The need to drive the sub-pixels at different voltages adds to the complexity of the display design. Such situations are especially prevalent in multi-gap RGB displays wherein a different sized cell gap, the distance between the panels in which the liquid-crystal is disposed, is utilized for each sub-pixel color. Because the required driving voltage for each cell is a function of the cell-gap, each color sub-pixel requires a different driving voltage. A display panel in which the sub-pixels for each color may be driven at a uniform voltage would simplify the design of the display driver circuits.

SUMMARY OF THE INVENTION

Accordingly, it is a goal of this invention to provide an active matrix liquid-crystal display panel having a tailored pushdown voltage for each color cell sub-pixel display element.

Another goal is to provide a liquid-crystal display in which the characteristics of the display may be precisely controlled.

These and other goals may be achieved by varying the size of the thin-film transistor (TFT) switch for each particular color sub-pixel display element. In addition, the size of the storage capacitor for each color cell may be varied to achieve and maintain the correct driving voltage. The size of the TFT switch and the size of the cell storage capacitor may be further varied in combination to achieve the necessary driving voltage levels for each cell.

It is to be understood that both the foregoing general description and the following detailed description are exemplary and explanatory only and are not restrictive of the invention as claimed.

The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DESCRIPTION OF THE PREFERRED EMBODIMENT

Reference will now be made in detail to the presently preferred embodiment of the invention, an example of which is illustrated in the accompanying drawings.

Figure 1:
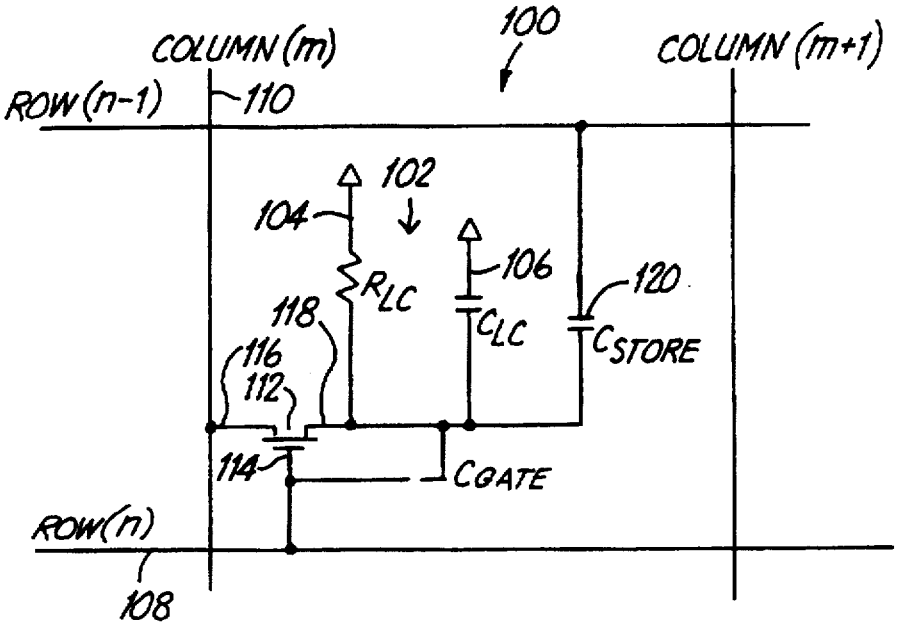
FIG. 1 is an schematic diagram of a typical display element utilized in an active matrix liquid-crystal display in accordance with the present invention.

Referring now to FIG. 1, a schematic diagram of a display element utilized in a liquid-crystal display (LCD) of the present invention is shown. The display element 100 may be a sub-pixel in a multicolor LCD, in which typically three primary colors, red, green and blue, are used in combination to produce multiple colors on the display. The display element 100 is designed to produce one particular color, i.e. red, green or blue, and thereby defines one of three sub-pixels in an RGB pixel triad. The display element 100 comprises a liquid-crystal 102 which may be electrically represented by a characteristic resistance ("$R_{LC}$") 104 and a characteristic capacitance ("$C_{LC}$") 106. The display element 100 may be activated by applying a voltage to the liquid-crystal 102 in order to induce an electric field thereacross. The bipolar molecules of the liquid-crystal 102 align in the induced electric field such that the liquid-crystal may operate as an electrically controlled light valve. The display element 100 may be accessed through display driver circuits (not shown) having an array of addressable row lines ("Row (n)") 108 and column lines ("Column (m)") 110.

The liquid-crystal 102 typically exhibits characteristic capacitance 106 and therefore may maintain a charge for a period of time. In order to prevent the charge from unintentionally bleeding over to adjacent display elements, an electronic switch 112 is utilized to operatively decouple the liquid-crystal 102 of the display element 100 from adjacent display elements and to further provide precise addressing of the display element 100 independent of adjacent elements. Typically the electronic switch 112 comprises a thin-film transistor (TFT) such as a MOSFET device having a gate electrode 114, a drain electrode 116 and a source electrode 118. The gate electrode 114 is connected to row line 108, the drain electrode 116 is connected to column line 110 and the source electrode 118 is connected to the liquid-crystal 102. The voltages for the column line 110 may be set by the display drivers wherein the display element 100 may be activated by sending an electrical signal to the row line 108.

The liquid-crystal 102 maintains a charge for a predetermined duration due to its characteristic capacitance 106. However, the value of the characteristic capacitance 106 often too small to hold the charge for a sufficient duration. Therefore, a storage capacitor ("$C_{store}$") 120 may be utilized to increase the overall effective capacitance of the display element 100 such that a charge is maintained on the liquid-crystal 102 for the desired duration. The storage capacitor 120 may be connected between the source electrode 118 of the TFT switch 112 and the previous row line ("Row (n-1)") 122. Additionally, a parasitic gate capacitor ("$C_{gate}$") 124 is connected between the gate electrode 114 and the source electrode 118 of the TFT switch 112.

Figure 2:
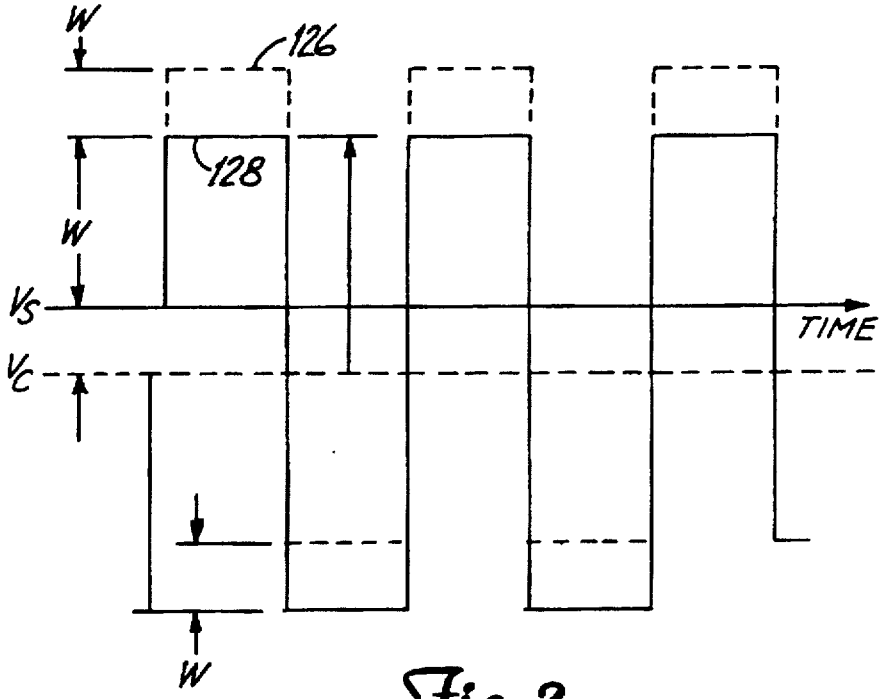
FIG. 2 is an illustration of the effect of tailoring the pushdown voltage on the display driving signal in accordance with the present invention.

Referring now to FIG. 2, the applied driving voltage for the display element of FIG. 1 is shown. The applied driving voltage signal 126 represents the voltage applied to the column line 110 which drives the drain electrode 116 of the TFT switch 112 of FIG. 1. The applied driving voltage 126 is typically a square wave signal symmetric about voltage level $V_s$. However, the applied signal voltage 126 will be lowered such that the effective signal voltage 128 is symmetric about a lower voltage level $V_c$ in order to drive the particular display element 100 at a precise voltage to obtain the desired color output. Thus, the applied voltage signal 126 will be pushed down to a voltage level $V_c$ by the pushdown voltage W as shown in FIG. 2.

The pushdown voltage W may be tailored to the voltage required for a particular display element 100 according to the color the display element 100 is to display. In order to obtain the desired pushdown voltage W, the size of the TFT 116 may be varied during the fabrication process for individual display elements. Thus, the TFT 116 of the red display elements may be fabricated to a first size, the TFT 116 of the green display elements may be fabricated to a second size and the TFT 116 of the blue display elements may be fabricated to a third size, for example.

The size of the TFT 112 directly affects the voltage applied to the liquid-crystal 102. The parasitic gate capacitance is proportional to the gate area. Thus, the gate size of the TFT 112 may be manipulated to tailor the pushdown voltage W of the display element 100. The size of the storage capacitor 120 may be manipulated according to the desired pushdown voltage W and the time required for element 102 to hold the charge.

The cell gap of the liquid-crystal display may be varied for each color, thus producing a multi-gap LCD. The cell gap size may be varied to obtain the proper optical performance for each color display element 100. The size of the TFT 112 and the size of the storage capacitor 120 may be varied in accordance with the varied cell gaps of a multi-gap LCD in order to further tailor the pushdown voltage W to obtain the desired pushdown voltage. Thus, each color cell may utilize the same applied driving voltage 126 received from the column drivers wherein the pushdown voltage for each color cell is tailored to the particular cell according to the size of the TFT 112, the size of the storage capacitor 120 and the size the cell gap for a given LCD type, each parameter being adjusted individually or in combination with the other parameters. Thus, the driver requirements are simplified in that the applied driving voltages 126 are uniform for each color pixel 102, thereby reducing the complexity of the driver circuitry and the display addressing routines.

The ability to tailor the pushdown voltage W for each color display element 100 allows for further control of the resulting output of the liquid-crystal display. For example, the color blue may show less intensity than other colors. The display elements 100 utilized for producing blue light may have a reduced size TFT 112 or storage capacitor 120. By tailoring the pushdown voltage W of the display element 100 for particular colors, the color balance of the entire LCD may be precisely controlled. Other parameters of the LCD may be similarly controlled to obtain the desired display characteristics including luminance, color balance and aperture ratio, for example.

It is believed that liquid-crystal display having a tailored pushdown voltage of the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A display element in a liquid-crystal display, the display element comprising:

(a) a liquid-crystal having a plurality of display element colors; and (b) a thin-film transistor switch operatively connected to said liquid-crystal for providing a driving voltage thereto in response to a display element activating input wherein the size of said thin-film transistor is selected such that the provided driving voltage is a version of the activating input signal offset by a predetermined pushdown voltage and is the same value for each of the display element colors.

2. A display element in a liquid-crystal display, the display element comprising:

(a) a liquid crystal display having a plurality of display element colors;

(b) a thin-film transistor switch operatively connected to said liquid-crystal for providing a driving voltage thereto in response to a display element activating input; and (c) a storage capacitor operatively connected in parallel with said liquid-crystal for maintaining a charge thereon wherein the size of said storage capacitor is selected such that the provided driving voltage is a version of the activating input signal offset by a predetermined pushdown voltage and is the same value for each of the display element colors.

3. The display element of claim 2 wherein said liquid crystal display element is disposed between first and second panels being separated by a distance comprising a cell gap, the size of said storage capacitor being selected in accordance with the size of said cell gap.

4.The display element of claim 2 wherein said thin-film transistor switch is a FET.

5. A display element in a liquid-crystal display, the display element comprising:

(a) a liquid crystal display having a plurality of display element colors:

(b) a thin-film transistor switch operatively connected to said liquid-crystal for providing a driving voltage thereto in response to a display element activating input: and (c) a storage capacitor operatively connected in parallel with said liquid-crystal for maintaining a charge thereon wherein the size of said storage capacitor and the size said thin-film transistor are selected such that the provided driving voltage is a version of the activating input signal offset by a predetermined pushdown voltage and is the same value for each of the display element colors.

* * * * *